United States Patent [19]

Hamil

[11] 3,994,196

[45] Nov. 30, 1976

[54] MUTE FOR STRINGED INSTRUMENT

[76] Inventor: David W. Hamil, 4314 N. Grand, Kansas City, Mo. 64116

[22] Filed: Aug. 1, 1975

[21] Appl. No.: 600,944

[52] U.S. Cl. ..... 84/273; 84/310
[51] Int. Cl.[2] ..... G10C 1/10
[58] Field of Search ..... 84/273, 310, 311

[56] References Cited

UNITED STATES PATENTS

| | | | |
|---|---|---|---|
| 1,754,544 | 4/1930 | Clark | 84/310 |
| 1,817,461 | 8/1931 | Page | 84/273 |
| 3,797,355 | 3/1974 | Law | 84/273 |

*Primary Examiner*—L. T. Hix
*Assistant Examiner*—Vit W. Miska
*Attorney, Agent, or Firm*—Lowe, Kokjer, Kircher, Wharton & Bowman

[57] ABSTRACT

A mute for a stringed instrument is provided by the present invention. A mounting plate is pivotally coupled with the framework of the instrument and in turn carries the muting element. The muting element is movable under a force exerted by a player of the instrument to apply a muting pressure to the bridge to mute the tone of the instrument. An arm rigid with the framework underlies the mounting plate and carries a camming plate. A pressure plate is pivotally coupled with the mounting plate and is engageable with the camming plate when moved in one direction to move the muting element away from the bridge and preclude any muting pressure from being applied to the bridge. Movement of the pressure plate in the opposite direction places the muting element in position for application of force to the bridge. A plurality of wedge members are engageable with the strings at a point behind the bridge to stretch the strings during muting of the instrument to compensate for the flatting effect of the muting element. A microphone pickup is mounted adjacent the head of the instrument and is coupled with an amplifier. A switch for the microphone pickup is opened and closed by movement of the pressure plate so as to turn the microphone on only when the mounting element is in position for application of force to the bridge.

15 Claims, 8 Drawing Figures

MUTE FOR STRINGED INSTRUMENT

This invention relates to musical instruments generally and, more particularly, to a mute for a stringed instrument characterized by a framework, a drum head stretched over the framework, and a plurality of strings stretched across the head and held away from the head by a bridge.

Devices for muting musical instruments have existed practically as long as the instruments themselves. With stringed instruments the muting effect is achieved by clamping the strings at various locations. To achieve a certain type of desirable muting effect it is necessary to clamp the bridge of a stringed instrument. Two devices typical of the prior art and intended for applying pressure to the bridge of a stringed instrument to mute the instrument are shown and described in U.S. Pat. Nos. 1,826,969 and 3,797,355.

Several problems have characterized all of the known muting devices of the prior art. One problem is that the mute is normally intended to rest on the bridge even when it is not being utilized thus making the mute subject to being accidentally applied by the player of the instrument. This has required that the mute be completely removed when not in use and eliminated the possibility of turning the mute off and on without interrupting a particular number.

It is therefore a primary object of the present invention to provide a mute which can be moved to an off position without completely removing the mute from the head of the instrument.

As a corollary to the above object, it is an objective of this invention to provide a mute for a stringed instrument wherein accidental application of the mute is nearly completely precluded.

Another disadvantage of mutes of the prior art is that the only way in which the force applied by the mute can be regulated is through the pressure applied by the player of the instrument. Thus while a player of the instrument may attempt to always repeat the amount of pressure with which the mute is applied it is not possible to accurately reproduce the amount of pressure applied each time the mute is used.

Accordingly, another important object of this invention is to provide a mute for a stringed instrument having a stop which can be adjusted and which limits the amount of pressure which may be applied through the mute. This allows for repetition of the force applied by allowing the player of the instrument to always use a maximum amount of force knowing that the rigid stop will preclude excess pressure from being applied to the bridge.

It is also one of the aims of this invention to provide a mute for a stringed instrument which can be swung completely away from the head of the instrument to an out of the way position for numbers where the mute is not to be used at all.

Still another disadvantage of mutes for stringed instruments as heretofore constructed has been their inability to compensate for the flatting effect which inherently occurs upon application of the mute. Accordingly, one of the objects of the present invention is to provide a mute for a stringed instrument which includes wedge members that engage the strings of the instrument to stretch the strings and compensate for the flatting effect of the muting element.

As a corollary to the above object, one of the aims of the invention is to provide a mute for a stringed instrument which includes tone compensating wedge members that are adjustable to stretch the strings of the instrument to different degrees depending upon the compensating effect desired.

Still another disadvantage of mutes of the prior art has been the inherent lowering of the level of sound produced by the instrument. This is particularly disadvantageous when the instrument is being played before a large crowd where the maximum amplitude of the instrument is needed to fill the auditorium. Accordingly, it is an object of the present invention to provide a mute for a stringed instrument which includes a microphone pickup in the vicinity of the head of the instrument to amplify the tone of the instrument whenever the muting element is applied.

A further objective of the invention is to provide a mute for a stringed instrument having a microphone pickup which is automatically turned on and off as the muting element is moved into and out of position for applying a muting force to the bridge of the instrument.

Still another one of the aims of my invention is to provide a mute for a stringed instrument which includes a microphone pickup the tone output of which may be varied in accordance with the requirements of a particular number or a particular room in which the number is being performed.

Other aims and objects of this invention will be made clear or become apparent from the following description and claims when read in light of the accompanying drawings wherein:

Figure 1:
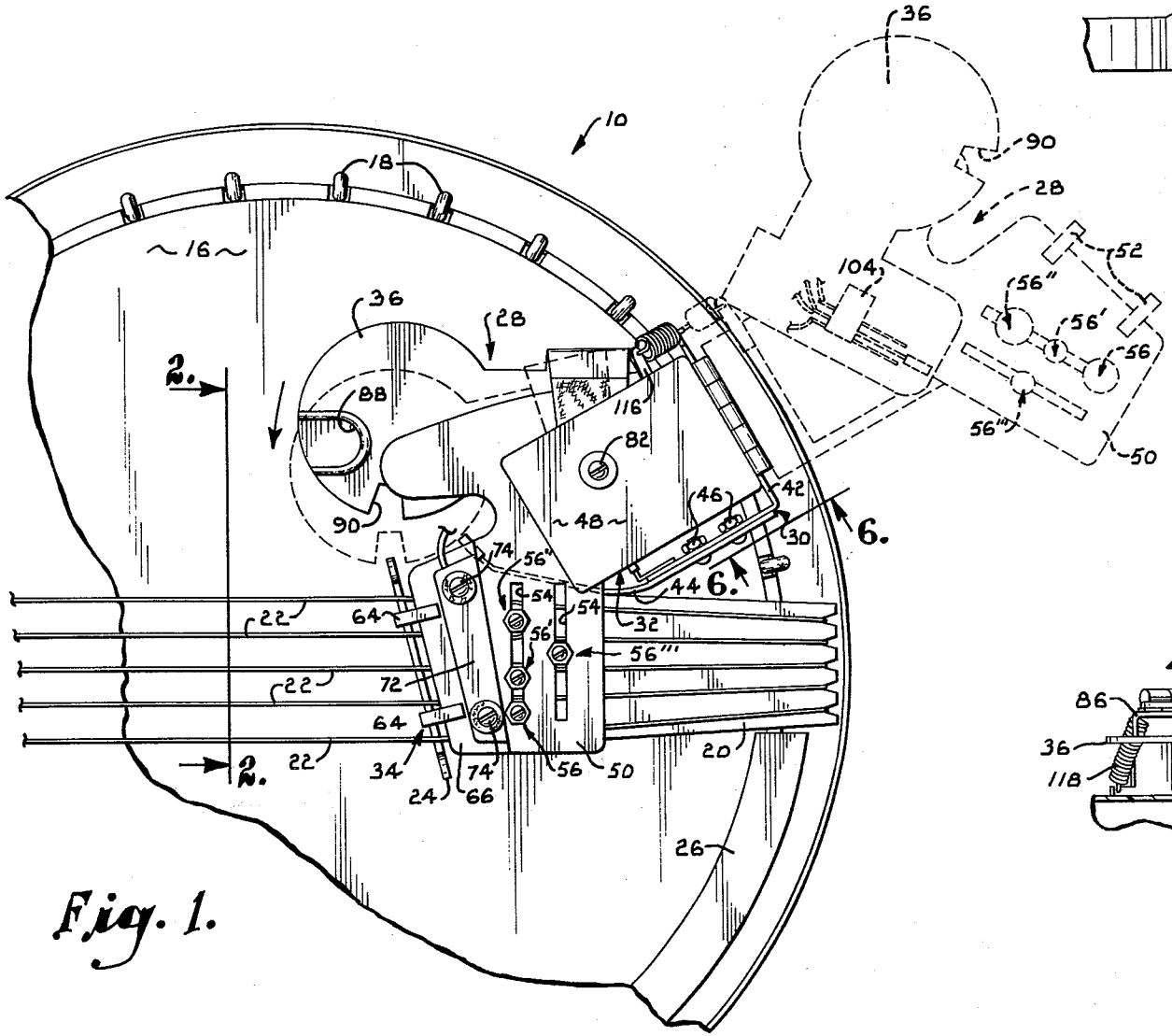
FIG. 1 is a fragmentary top plan view of a stringed musical instrument with the mute of the present invention being secured thereto.

Referring initially to FIG. 1, a banjo is designated generally by the numeral 10 and is intended to typify the type of stringed instrument with which the present invention is utilized. Banjo 10 comprises a hollow framework 12, a rim 14 which holds a drum head 16 taut over the framework, and a plurality of circumferentially spaced tensioning screws 18 which fit over the rim to hold it in place.

A tail piece 20 is secured to framework 12 and a plurality of strings 22 are stretched tight over the tail piece and extend from the latter to the end of a long neck (not shown) which extends away from the framework. Strings 22 are held in raised relationship to head 16 by a bridge 24 positioned off center but near the middle of the head. An arm rest 26 is disposed in overlying relationship to an arcuate section of rim 14 in the area adjacent the tail piece 20.

Figure 6:
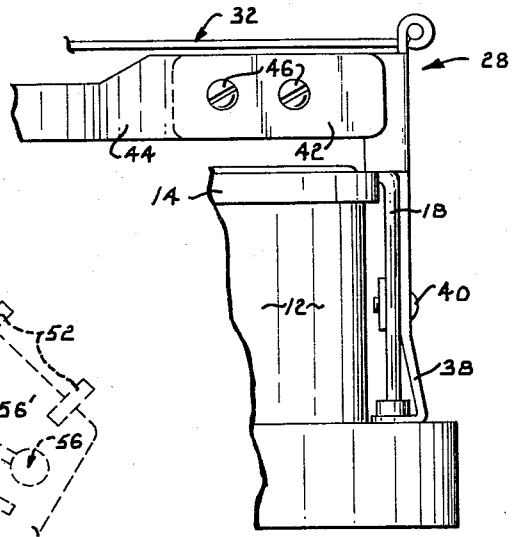
FIG. 6 is an enlarged fragmentary cross sectional view taken through the head of the instrument along line 6—6 of FIG. 1.

The mute of the present invention is designated generally by the numeral 28 and comprises a rigid arm 30, a pivotal mounting plate 32, a muting element 34 and a pivotal pressure plate 36. A mounting bracket 38 (FIG. 6) extends in generally parallel relationship to framework 12 and is held rigid with the latter via a tensioning screw assembly 40. Arm 30 is held rigid with bracket 38 in the following manner. An L-shaped section 42 of arm 30 is soldered or otherwise rigidly fixed to bracket 38 and this section in turn mounts a second arm section 44 through utilization of a pair of nut and bolt assemblies 46. This particular construction of rigid arm 30 allows the second arm section 44 to be adjustably positioned relative to head 16 as more fully explained hereinafter.

The mounting plate 32 is hingedly coupled with the uppermost extension of bracket 38. Mounting plate 32 includes a first polygonal section 48 and a second section 50 of irregular configuration which extends in a plane generally parallel to the plane of head 16 and also transversely overlying strings 22. The second section 50 is held in rigid relationship with section 48 by soldering or the like. Second section 50 provides a mounting platform for the muting element 34 which comprises two spaced apart feet 52 which are adapted to engage bridge 24.

Figure 5:
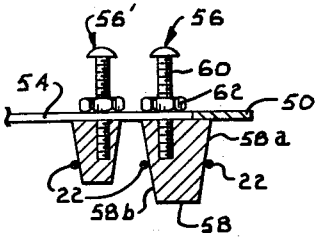
FIG. 5 is a fragmentary enlarged cross sectional view taken along 5—5 of FIG. 3.

Section 50 of the mounting plate 32 is also provided with two longitudinally extending slots 54 which transversely overlie strings 22 and serve to mount a plurality of wedging members designated generally by the numeral 56 (see FIG. 5). Each wedging member 56 comprises a frusto-conical wedging element 58 characterized by inclined diverging surfaces 58a and 58b which are engageable with strings 22. Embedded in wedging element 58 is a bolt 60 which projects outwardly from one end of the element. A nut 62 is received by the threaded shaft of the bolt and is tightened down against the second plate section 50 to lock element 58 in place. It is to be noted that a second wedging member of slightly smaller size than wedging member 56 is located adjacent the latter and is designated generally by the numeral 56'. Construction of this second wedging member is identical to the wedging member 56 above described. Third and fourth wedging members are designated by the numerals 56'' and 56''' and it is to be understood that these wedging members are generally of the same size as one or the other of wedging members 56 and 56' and identical in construction thereto.

Figure 2:
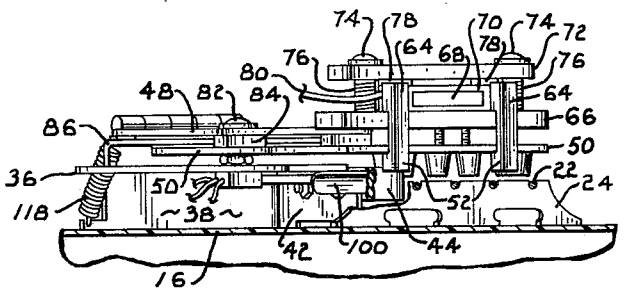
FIG. 2 is an enlarged cross sectional view through the head of the instrument shown in FIG. 1 and taken along line 2—2.

As best illustrated in FIG. 2, an integral extension of each of the feet 52 extends upwardly away from section 50 in generally perpendicular relationship to the latter. Each extension presents a standard 64 for mounting a vibrator bar 66. Bar 66 is held in rigid relationship with extensions 64 by soldering or other appropriate means and is also held in rigid spaced relationship to section 50 of mounting plate 32. A microphone pickup 68 is held in a box 70 which is mounted on bar 66. The box 70 is, in turn, held in place on the bar by a tone adjustment plate 72 and two screws 74 which extend down through the plate 72 and into the bar 66. Plate 72 is held in spaced relationship relative to bar 66 by coil springs 76. A pad 78 between plate 72 and bar 66 precludes vibrations from being transferred between the two. Lead wires 80 extend from the microphone pickup 68 to a switch described hereinafter.

A bolt 82 extends through both first and second sections 48 and 50 and receives a collar 84 to pivotally mount pressure plate 36 through an L-shaped arm 86 which is rigid with the collar and the pressure plate. Pressure plate 36 includes a finger rest 88 and has a notch 90 to accommodate positioning of the plate adjacent bridge 24.

Figure 4:
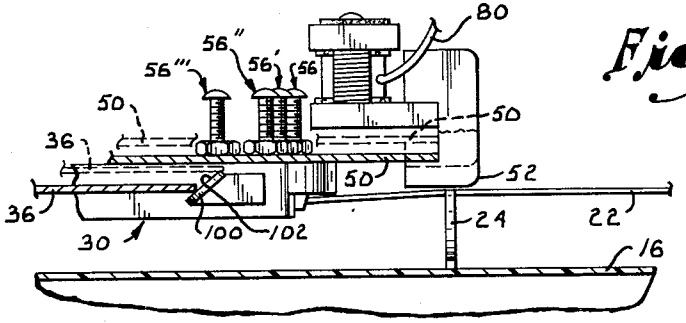
FIG. 4 is an enlarged cross sectional view taken along 4—4 of FIG. 3.

As pressure plate 36 is pivoted away from bridge 24 it engages an ear 100 which is rigid with and projects laterally from rigid arm 30. Ear 100 presents a camming surface 102 to lift pressure plate 36 and mounting plate 32 upwardly from the solid line positions shown in FIG. 4 to the broken line positions shown in this Fig. This in turn lifts feet 52 off of bridge 24.

A switch 104 is mounted on the underside of pressure plate 36 and includes a ground 106, a stationary contact 108 and a movable contact 110. This switch connects microphone pickup 68 with an appropriate amplifier (not shown) through lead wires 112. Movable contact 110 is engageable with an L-shaped switching arm 114 which is rigidly mounted on section 42 of rigid arm 30.

As best illustrated in FIG. 2, a lateral projection 116 which is rigid with section 48 of mounting element 34 mounts one end of a coil spring 118. The other end of spring 118 is secured to mounting bracket 38. The tension of the spring thus acts to provide a slight downward force on mounting plate 32 and pressure plate 36.

The mute 28 may be more or less permanently mounted on banjo 10 and when it is not desirable to use the mute during a particular number or series of numbers it is moved to the out of the way position illustrated in broken lines in FIG. 1. This is possible by virtue of the hinge coupling bewteen polygonal section 48 and mounting bracket 38. When the mute is to be used it is pivoted into the position shown in solid lines in FIG. 1. Even when the mute is in this "ready" position the muting element 34 will remain out of contact with bridge 24 by virtue of the inter-engagement of pressure plate 36 and camming surface 102. In this position the positive locking arrangement which is provided substantially precludes even accidental application of the mute prior to the time it is needed.

When the muting effect is desired pressure plate 36 is pivoted into the broken line position illustrated in FIG. 1. This moves plate 36 down off of ear 100 and lowers feet 52 from the raised positions shown in FIG. 2 down onto bridge 24. In this regard, it should be understood that the distance between the bottom of feet 52 and the top of bridge 24 is only a very small fraction of an inch even when the feet are in their raised position. The distance shown in the drawings is somewhat exaggerated over the distance which may actually be necessary and this exaggeration has been made for purposes of illustration only.

As feet 52 are placed in engagement with bridge 24, the player of the instrument applies pressure to the bridge through the feet by applying a downward force on pressure plate 36. It is to be noted that when the muting element is being applied to the bridge as aforedescribed the effective pressure which can be applied by the player of the instrument is limited by virtue of engagement of section 50 with rigid arm 30. Thus the arm provides a stop which precludes excessive application of force from resulting in excessive pressure being applied to the bridge. This makes the reproducibility of the results obtainable with the mute of the present invention substantially superior to known prior art devices. Also, rigid arm 30 provides for an effective means of varying the maximum pressure which can be applied to the bridge 24. This is accomplished by loosening nut and bolt assemblies 46 and moving arm section 44 either upward or downward to allow less or more force to be translated through fee 52 to bridge 24.

Figure 3:
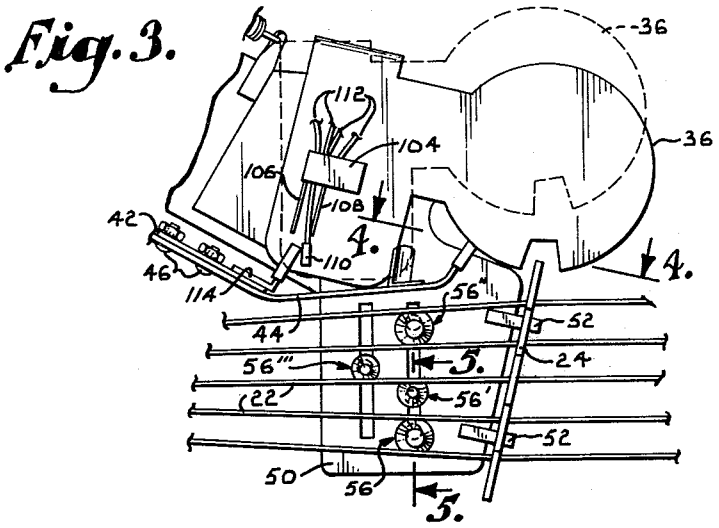
FIG. 3 is a fragmentary bottom plan view of the mute of the present invention illustrating the manner in which the tone compensating wedge members engage the stringe of the instrument.

As pressure plate 36 is pivoted from the solid line position shown in FIG. 1 (the broken line position in FIG. 3) to the broken line position shown in this FIG. (the solid line position shown in FIG. 3) contact 110 engages arm 114 to close the contacts of switch 104 and turn on the microphone pickup 68 for the amplifier (not shown). Thus the microphone is turned on simultaneously with application of muting element 34 to the bridge. It is also desirable to employ a small resistor (not shown) in series with switch 104 and pickup 68 to prevent a "popping noise" as the contacts are opened and closed. By virtue of the switching arrangement and microphone pickup 68 the sound produced by the instrument can be maintained at the same level even though the tone is substantially varied by virtue of the muting effect. It is also possible to vary the muting tone to some degree through tightening or loosening of tension screws 74. This varies the force with which box 70 is held in place and will in turn vary the vibratory forces reaching microphone pickup 68.

Still another event occurs simultaneously with the application of the muting element to the bridge and closing of switch 104 to activate microphone pickup 68. Namely, as the plate section 50 is moved downwardly from the solid line to the broken line position illustrated in FIG. 4, the sides of wedging elements 58 will force strings 22 in a generally horizontal direction to stretch the strings tighter and compensate for the flatting effect attributable to engagement of muting element 34 with bridge 24. Manifestly, the precise degree of compensatory effect which wedging elements 58 have on strings 22 is adjustable through bolts 60. By loosening nut 62, the bolt 60 is rotatable and its off center location in element 58 causes a substantial camming effect to move strings more or less in a lateral direction depending upon the direction of rotation of the screw. When the desired amount of compensating stretch of strings 22 is achieved, nut 62 is tightened to hold the wedging element in this position.

Figure 7:
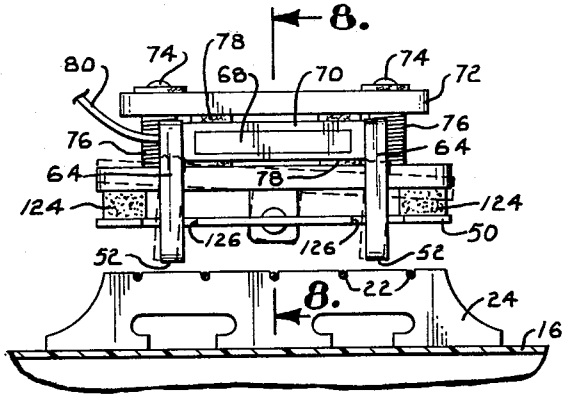
FIG. 7 is a fragmentary elevational view of a modified form of the invention.
Figure 8:
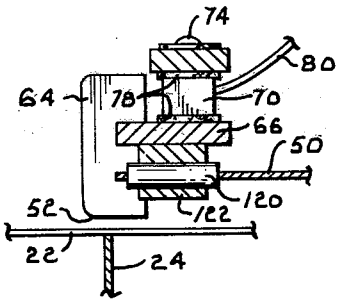
FIG. 8 is a vertical cross sectional view of the modified form of the invention taken along line 8—8 of FIG. 7.

An alternative form of the invention is illustrated in FIGS. 7 and 8 and will now be described. In this form of the invention a ferrule 120 is rigid with section 50 of mounting plate 32. This ferrule pivotally receives a sleeve 122 which in turn is rigidly coupled with vibrator bar 66. Feet 52 are rigid with bar 66 through integral extension 64 as previously described for the preferred embodiment. Microphone pickup 68 and its associated box housing 70 are again carried on bar 66 by tensioning screws 74 and tone adjustment plate 72.

Two small resilient balance pads 124 are secured to the side of section 50 which is adjacent bar 66. Also, a pair of notches 126 are provided in plate section 50 to accommodate limited movement of feet 52.

By virtue of the foregoing alternative construction, vibrator bar 66 and feet 52 of the muting element are pivotal about the axis presented by ferrule 120. This assures that equal pressure will be applied at both contact points of the feet with the bridge regardless of the way in which force is applied through pressure plate 36. In all other respects, construction of the alternative embodiment of the invention is the same as for the preferred embodiment described above. When no pressure is being applied through plate 36, the resilient pads 124 will return bar 66 and feet 52 to the normal position shown in solid lines in FIG. 7.

While the invention has been described with particular reference to a banjo, it will readily be appreciated that the mute of the present invention has application to other types of stringed instruments. Various modifications from the precise embodiment herein described are contemplated as being within the scope of this invention which is intended to be limited only by the claim appended hereto.

Having thus described my invention what I claim and desire to be secured by Letters Patent is:

1. A mute adapted to be used with a stringed instrument characterized by a framework, a drum head stretched over the framework and a plurality of strings stretched across the head and held away from the head by a bridge extending upwardly from the head, said mute comprising:

an arm rigid with the framework and extending over said head; a mounting plate pivotally coupled with said framework and extending in overlying relationship to said arm; a muting element carried by said plate and engageable with said bridge;

said mounting plate being positioned to hold said muting element over said bridge;

said muting element being movable under a force exerted by a player of the instrument to apply a muting pressure to said bridge whereby to mute the tone of the instrument;

a pressure plate pivotally coupled with said mounting plate and movable to and from a position adjacent the bridge; and camming means rigid with said arm;

said pressure plate being engageable with said camming means when moved in one direction to move said mounting plate and thereby said muting element away from said bridge and preclude any muting pressure from being applied to the bridge.

2. The invention of claim 1, wherein is included at least one wedge member carried by said mounting plate and engageable with at least one of said strings to stretch the string while pressure is applied to the bridge through the muting element, said wedge member thereby compensating for the flatting effect of the muting element.

3. The invention of claim 1, wherein said muting element comprises a plurality of feet adapted to engage said bridge at spaced apart locations.

4. The invention of claim 1, wherein is included a microphone pickup mounted adjacent said head, said pickup being adapted to be coupled with an amplifier for amplifying the tone of the instrument.

5. The invention of claim 2, wherein each of said wedge members is engageable with at least one of said strings so as to stretch the string in a direction generally parallel to the plane of the head.

6. The invention of claim 3, wherein said muting element is pivotally mounted on said plate for movement about an axis extending transversely of the bridge intermediate said feet and in a plane generally parallel to the plane of the bridge surface.

7. The invention of claim 4, wherein is included electrical switch means for said pickup, said switch means comprising at least two contacts, said contacts being mounted for movement to a closed position upon pivoting of said pressure plate in the other direction whereby to turn on said pickup whenever said muting element is in position to apply said muting pressure.

8. The invention of claim 7, wherein is included at least one wedge member carried by said mounting plate and engageable with at least one of said strings to stretch the string while pressure is applied to the bridge through the muting element, said wedge member thereby compensating for the flatting effect of the muting element.

9. The invention of claim 5, wherein each of said wedge members comprises a wedging component which projects toward the head from a location adjacent at least one of said strings and a stem rigid with and projecting from said component in a direction away from the head, said stem being positioned in said wedge component at an off center location so that partial rotation of said stem results in a camming action of the wedge against the adjacent string whereby to stretch the latter.

10. The invention of claim 9, wherein is included means for locking said wedge member in a particular position for repeatedly imparting the same camming effect on an adjacent string of the instrument.

11. The invention of claim 7, wherein is included a first mounting plate coupled with said muting element;

a second mounting plate coupled with said first mounting plate, and with said pickup being sandwiched between said first and second plates.

12. The invention of claim 11, wherein is included means for varying the tension on said pickup applied by said first and second plates.

13. The invention of claim 8, wherein each of said wedge members is engageable with at least one of said strings so as to stretch the string in a direction generally parallel to the plane of the head.

14. The invention of claim 13, wherein each of said wedge members comprises a wedging component which projects toward the head from a location adjacent at least one of said strings and a stem rigid with and projecting from said component in a direction away from the head, said stem being positioned in said wedge component at an off center location so that partial rotation of said stem results in a camming action of the wedge against the adjacent string whereby to stretch the latter.

15. The invention of claim 14, wherein is included means for locking said wedge member in a particular position for repeatedly imparting the same camming effect on an adjacent string of the instrument.

* * * * *